US005652978A

United States Patent [19]

Wiig

[11] Patent Number: 5,652,978

[45] Date of Patent: Aug. 5, 1997

[54] COUNTERBALANCED MOVING PIVOT FOLDING BED

[76] Inventor: Selmer Wiig, 1610 Maple Ave., Redlands, Calif. 92374

[21] Appl. No.: 528,398

[22] Filed: Sep. 14, 1995

[51] Int. Cl.[6] ..... A47C 17/38

[52] U.S. Cl. ..... 5/144; 5/137; 5/166.1; 5/136

[58] Field of Search ..... 5/136, 144, 137, 5/148, 166.1, 53.1

[56] References Cited

U.S. PATENT DOCUMENTS

| | | | |
|---|---|---|---|
| 203,728 | 5/1878 | Hall | 5/164.1 |
| 376,126 | 1/1888 | Williams | 5/144 |
| 484,722 | 10/1892 | Penney | 5/144 |
| 493,043 | 3/1893 | Piper | 5/144 |
| 562,269 | 6/1896 | Auerbach | 5/136 |
| 1,094,684 | 4/1914 | Snyder | 5/166.1 |
| 2,724,128 | 11/1955 | Schultz et al. | 5/136 |

*Primary Examiner*—Flemming Saether
*Attorney, Agent, or Firm*—James E. Brunton

[57] ABSTRACT

A folding bed apparatus having a novel moving pivot that enables the bed to be moved effortlessly from a generally horizontal operational position to a generally vertical stowed position within an attractive enclosure and also to be pulled away from the enclosure for sleeping and to permit free access to the mattress. A novel safety locking mechanism is provided to maintain the bed in the generally horizontal position when it is pulled outwardly from the storage enclosure. When the bed is in the stowed position, a comfortable seating bench is provided to accommodate one or more persons.

4 Claims, 12 Drawing Sheets

FIG. 11
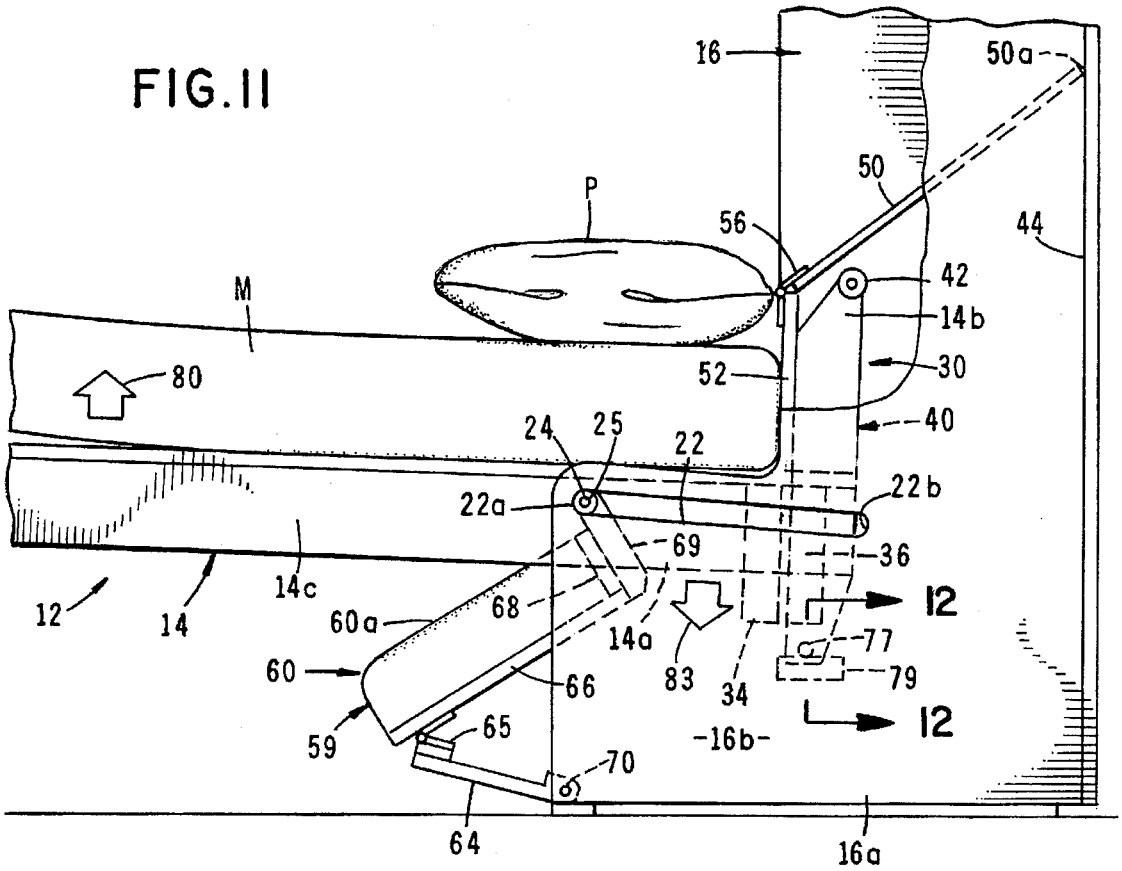
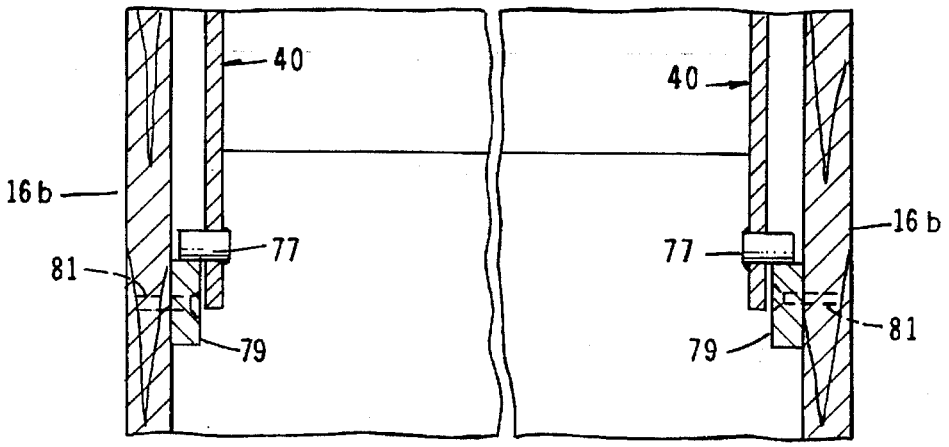
FIG. 12

COUNTERBALANCED MOVING PIVOT FOLDING BED

BACKGROUND OF THE INVENTION

1. Field of the Invention

The present invention relates generally to folding beds. More particularly, the invention concerns a novel counterbalanced, moving pivot-folding bed which is easily movable from a generally horizontal position to a generally vertical storage position.

2. Discussion of the Invention

Folding, or cupboard beds, are not new. One such bed, commonly known as the "Murphy" bed, has been in existence for many years. A number of spring operated variations of the Murphy bed have also been suggested in the past and have met with varying commercial success.

In addition to the spring-operated type folding beds, folding beds using counterweights in place of springs have been suggested. Exemplary of one such construction is that disclosed in U.S. Pat. No. 2,724,128 issued to Schulz.

Common drawbacks of many of the prior art folding beds include their complexity of design and their difficulty of installation and use. The so called Murphy type bed is generally quite heavy and embodies rather complex spring operated retraction mechanisms. Many of the spring-retraction type folding beds and certain of the counterbalance-type folding beds are quite difficult for elderly persons and persons of frail stature to operate. Additionally, prior art folding beds tend to be quite bulky and the enclosures for the bed often take up considerable space.

The thrust of the present invention is directed toward overcoming many of the drawbacks of prior art folding beds of the character described in the preceding paragraphs. In this regard, as will be better appreciated from the discussion which follows, the novel folding bed of the present invention is of a simple and elegant design, making it very easy to operate even by people of limited physical strength. By correctly positioning the counterbalance, the effect of gravity is negated so opening and closing force is equal to opening and closing a normal household door. The bed also includes a novel rolling pivot which permits the bed to be easily pulled away from the bed enclosure to provide easy access to the rear of the mattress while making the bed. The moving pivot feature of the design permits the bed to be opened and closed while fully made and smooth operation is assured by the low friction roller design of the counterbalancing mechanism. Further, the moving pivot feature permits a reduction in the depth of the bed enclosure of on the order of thirty-five percent when compared to prior art devices. This is because the prior-art, fixed-pivot beds require additional space at the rear of the enclosure to clear the counterbalanced end of the bed as it moves from a horizontal position into a vertical storage position. The novel moving pivot feature of the device of the present invention uniquely overcomes this drawback.

SUMMARY OF THE INVENTION

It is an object of the present invention to provide a novel folding bed which is of simple design and is easy to use by elderly persons, children and persons having limited physical strength.

Another object of the invention is to provide a folding bed of the character described which embodies a novel pivot arrangement that enables the bed to be moved from a generally horizontal position to a generally vertical storage position and also to be pulled away from its enclosure to permit free access to the mattress. In this regard a novel safety locking mechanism is provided to maintain the bed in a generally horizontal position when it is pulled outwardly from the storage enclosure. When the bed is in the extended position, the user can, if desired, sleep with the head located outside the bed enclosure.

Another object of the invention is to provide a folding bed of novel design which can be moved into a vertical storage position when fully made up. In this connection, a pillow capture panel is provided to prevent the pillow from rubbing against the back of the bed during opening and closing. Additionally, as the bed is moved toward its vertical storage position, the bed covers will naturally fall downwardly relative to the mattress into a made-up configuration.

Another object of the invention is to provide a folding bed of the type described in the preceding paragraphs which also includes a novel bench construction which provides a comfortable seating area when the bed is disposed in its stowed configuration.

Another object of the invention is to provide a folding bed construction which will receive mattresses of standard, commercially available sizes.

Another object of the invention is to provide a folding bed design which can be constructed from standard commercially available components thereby making it simple and inexpensive to fabricate.

BRIEF DESCRIPTION OF THE DRAWINGS

FIG. 11 is a fragmentary, side-elevational view similar to FIG. 9, but showing the locking means positively securing the folding bed against upward movement toward a stowed configuration.

FIG. 12 is a greatly enlarged, cross-sectional view taken along lines 12—12 of FIG. 11.

DESCRIPTION OF THE INVENTION

Figure 1:
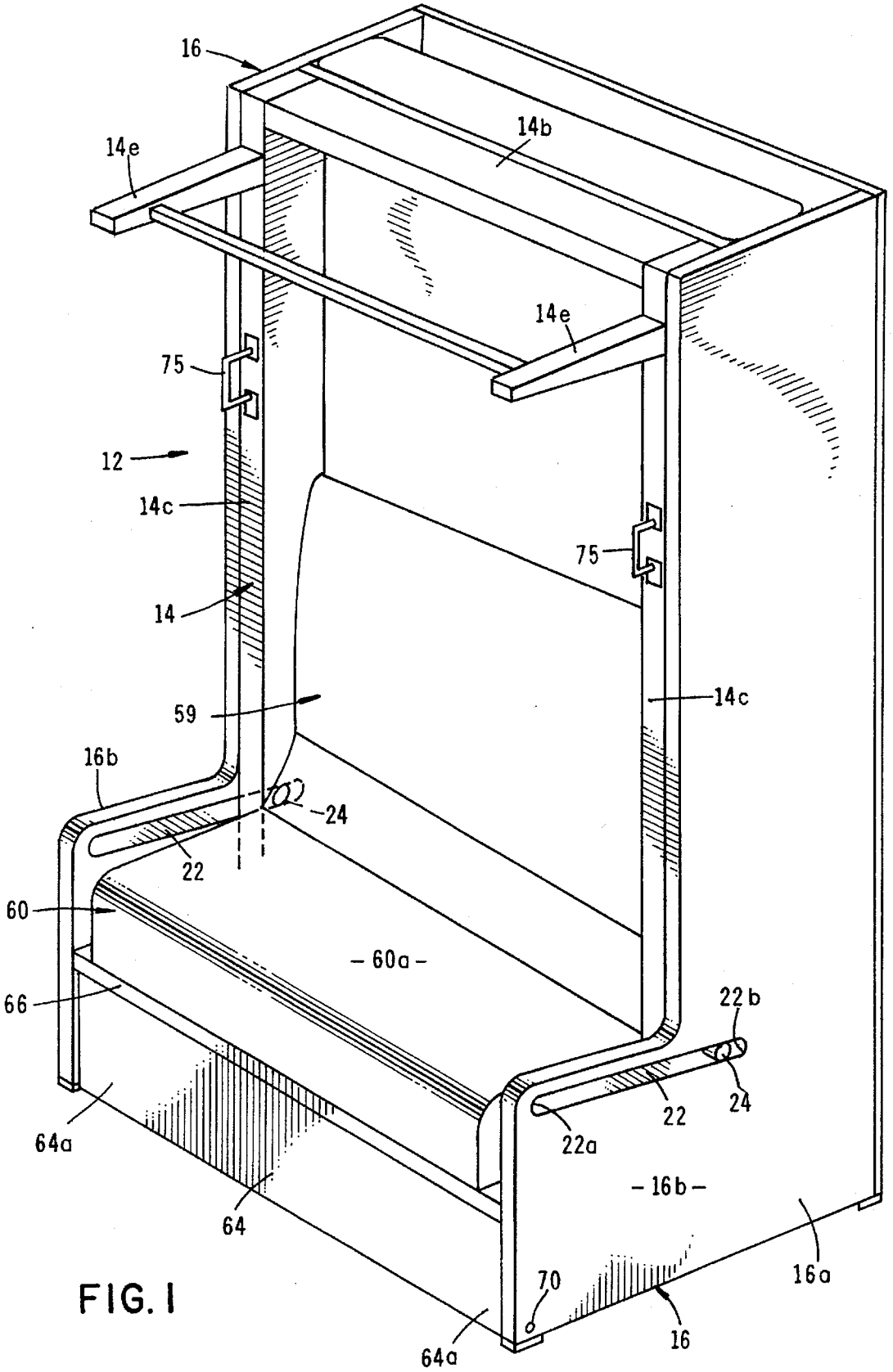
FIG. 1 is a generally perspective view of one form of the counterbalance, moving pivot folding bed of the invention.
Figure 2:
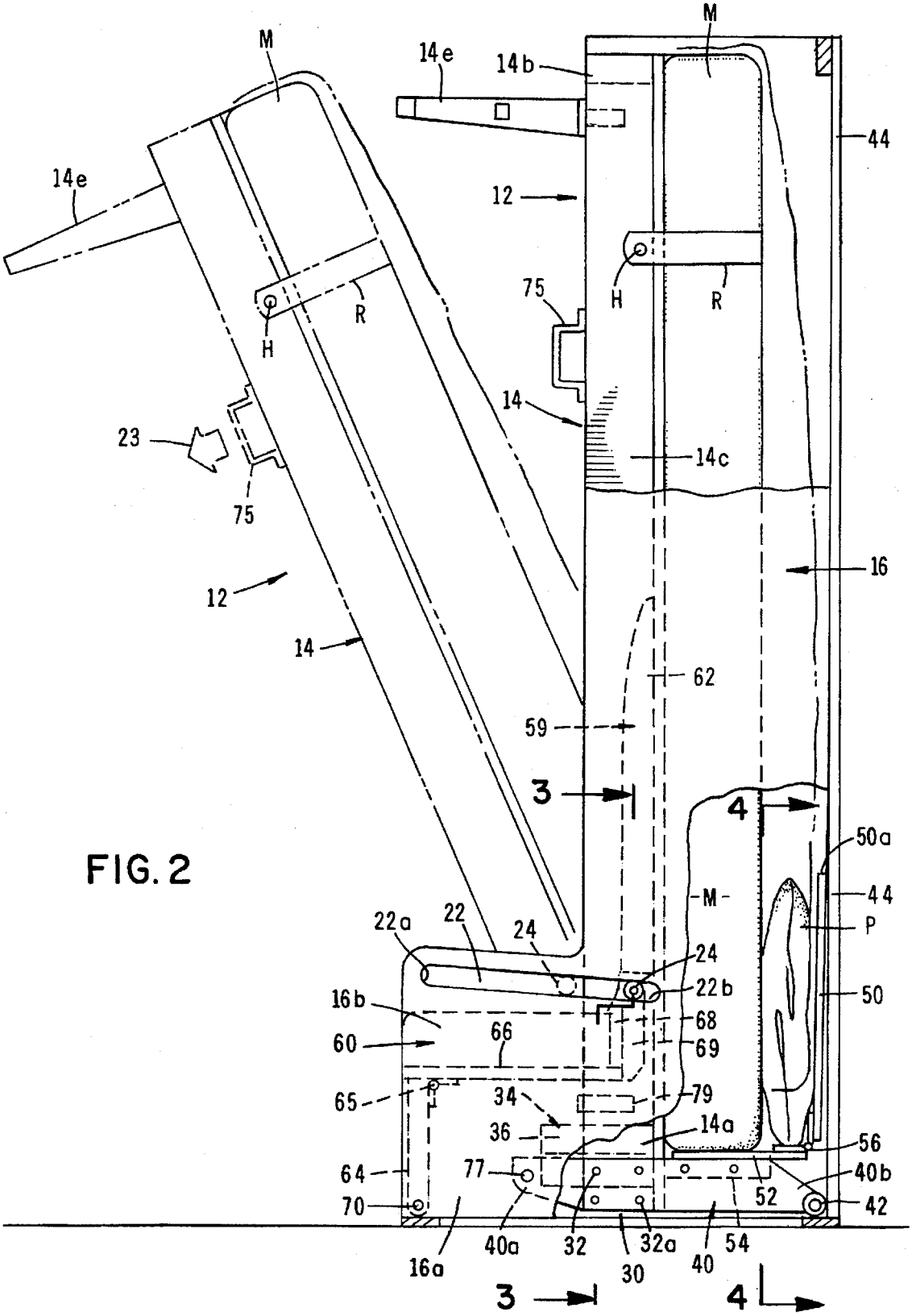
FIG. 2 is a side-elevational view of the folding bed showing, in phantom lines, movement of the bed from a stowed configuration toward a generally horizontal, operational configuration.
Figure 3:
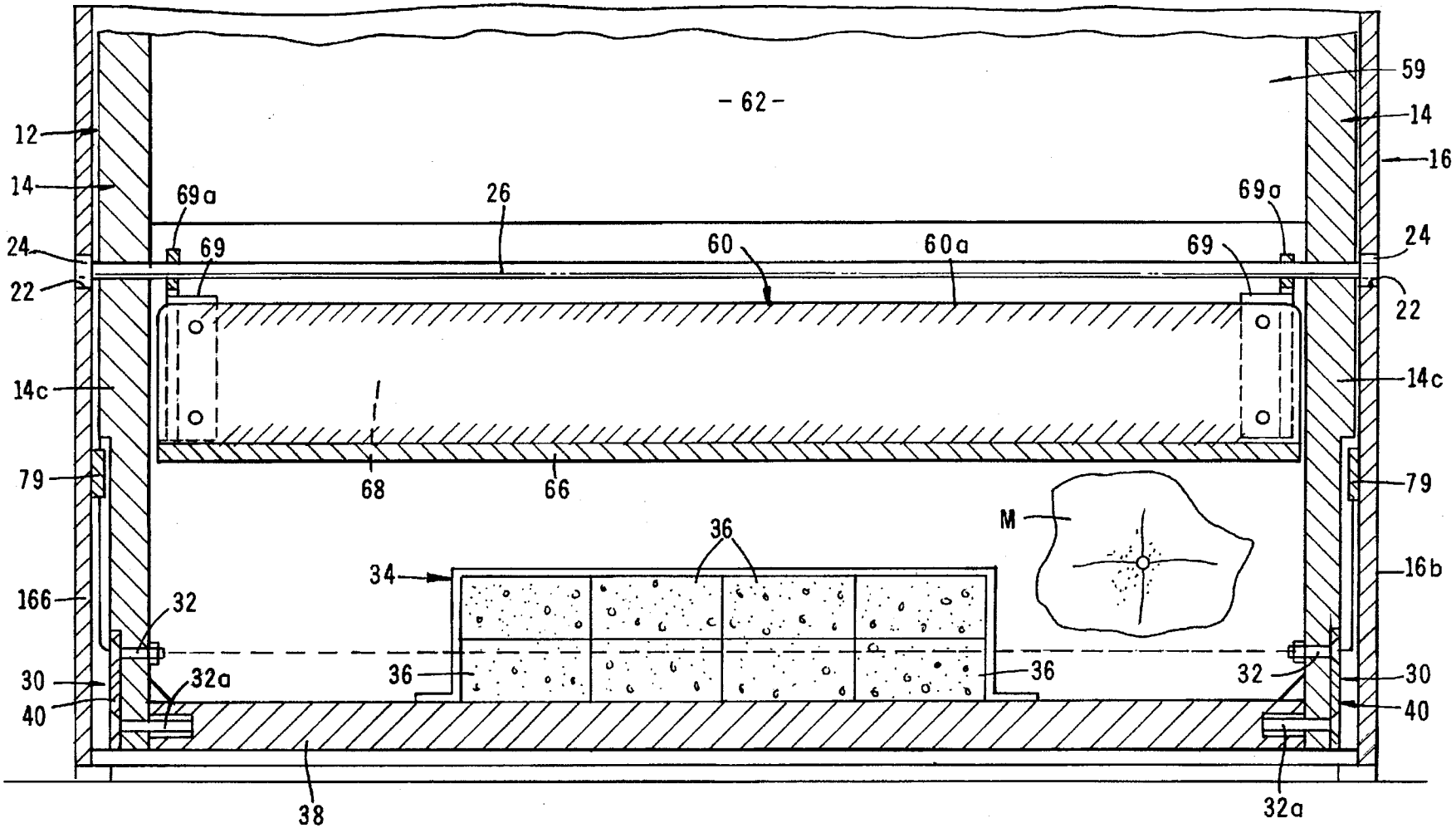
FIG. 3 is a cross-sectional view taken along lines 3—3 of FIG. 2.

Referring to the drawings and particularly to FIGS. 1, 2, and 3, one form of the counterbalanced, moving-pivot, folding bed of the invention is there illustrated. This embodiment of the invention comprises a free-standing unit which includes a bed pallet assembly 12 comprising a mattress supporting bed pallet 14 which is pivotally connected to the base portion 16*a* of a storage enclosure 16. As best seen in FIG. 1, enclosure structure 16 functions to enclose the bed pallet and the mattress when the bed is in its upright, stowed configuration.

Figures 5, 6:
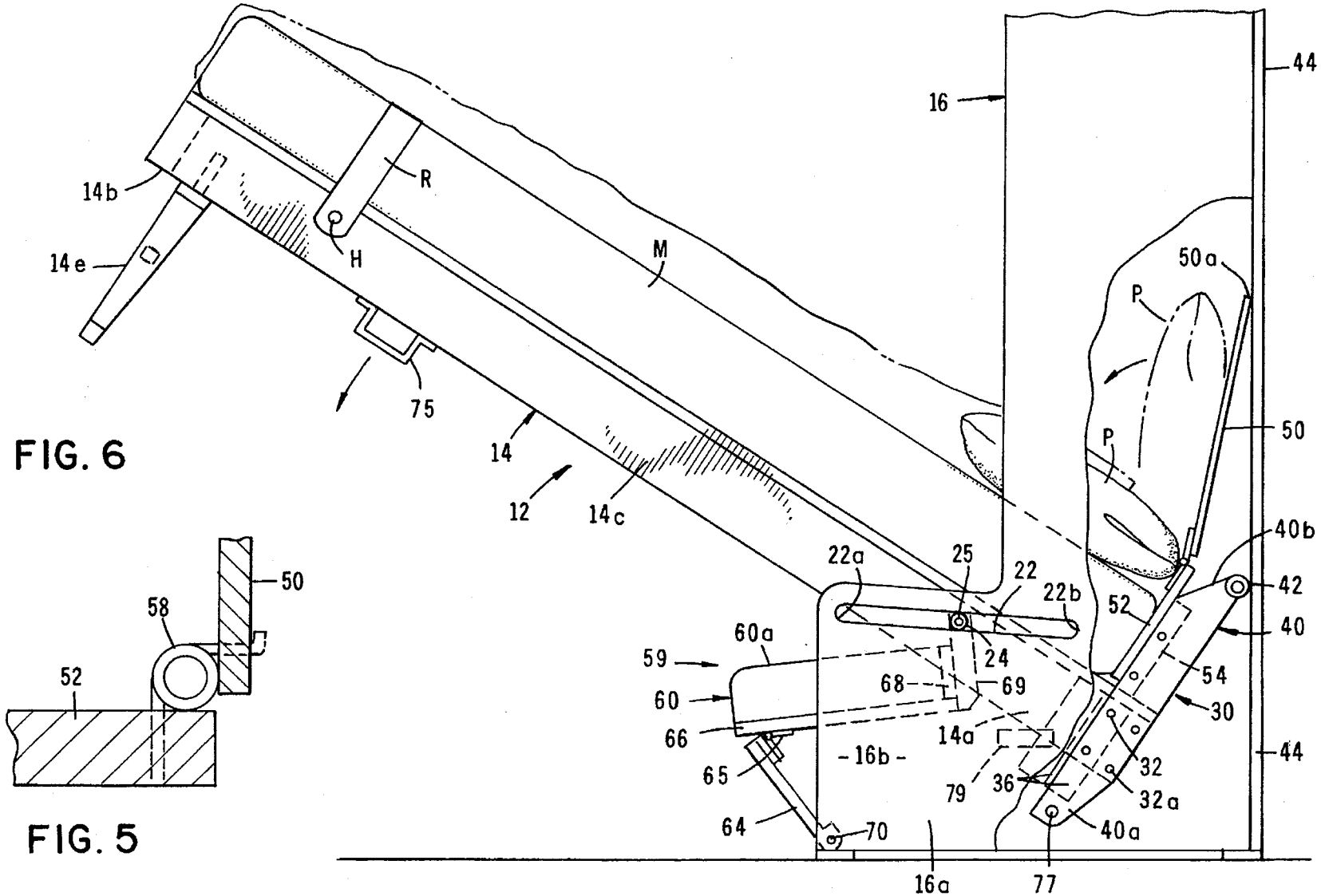
FIG. 5 is an enlarged, cross-sectional view taken along lines 5—5 of FIG. 4.
FIG. 6 is a side-elevational view similar to FIG. 2 showing the bed moving further downwardly toward an operational configuration.

Base portion 16*a* of enclosure 16 is formed by two transversely spaced-apart lower side portions 16*b*, each of which is provided with a longitudinally extending track means, shown here as an elongated slot having a roller engaging surface, or track 22. As best seen in FIGS. 1 and 6, tracks 22 are inclined downwardly from the first end 22 of the track to second end 22*b* of the track. As best seen in FIG. 6, bed pallet 14 has a front end 14*a*, a rear end 14*b* and transversely spaced apart sides 14*c*. Interconnected with sides 14*c* are pivot means, here comprising rollers 24 which are adapted to roll along inclined tracks 22. Each of the rollers 24 is supported by pivot axles 25 which are connected to sides 14*c*. With this construction, pallet 14 is free to pivot about the axis of the pivot axles from a substantially horizontal first position shown in FIG. 7 to a substantially vertical second position shown by the solid lines in FIG. 2 (see also FIG. 8). Rollers 24 also comprise a part of the moving means of the invention for moving pallet 14 in a generally horizontal direction from a first forward position shown in FIG. 7 to a second extended position shown in FIG. 9. As best seen by referring to FIGS. 3 and 8 in this embodiment, pivot axles 25, which comprise a part of the pivot means, are connected proximate each end of a transversely extending bar 26 which spans the distance between side walls 14*c* of bed pallet 14.

Figures 7, 8:
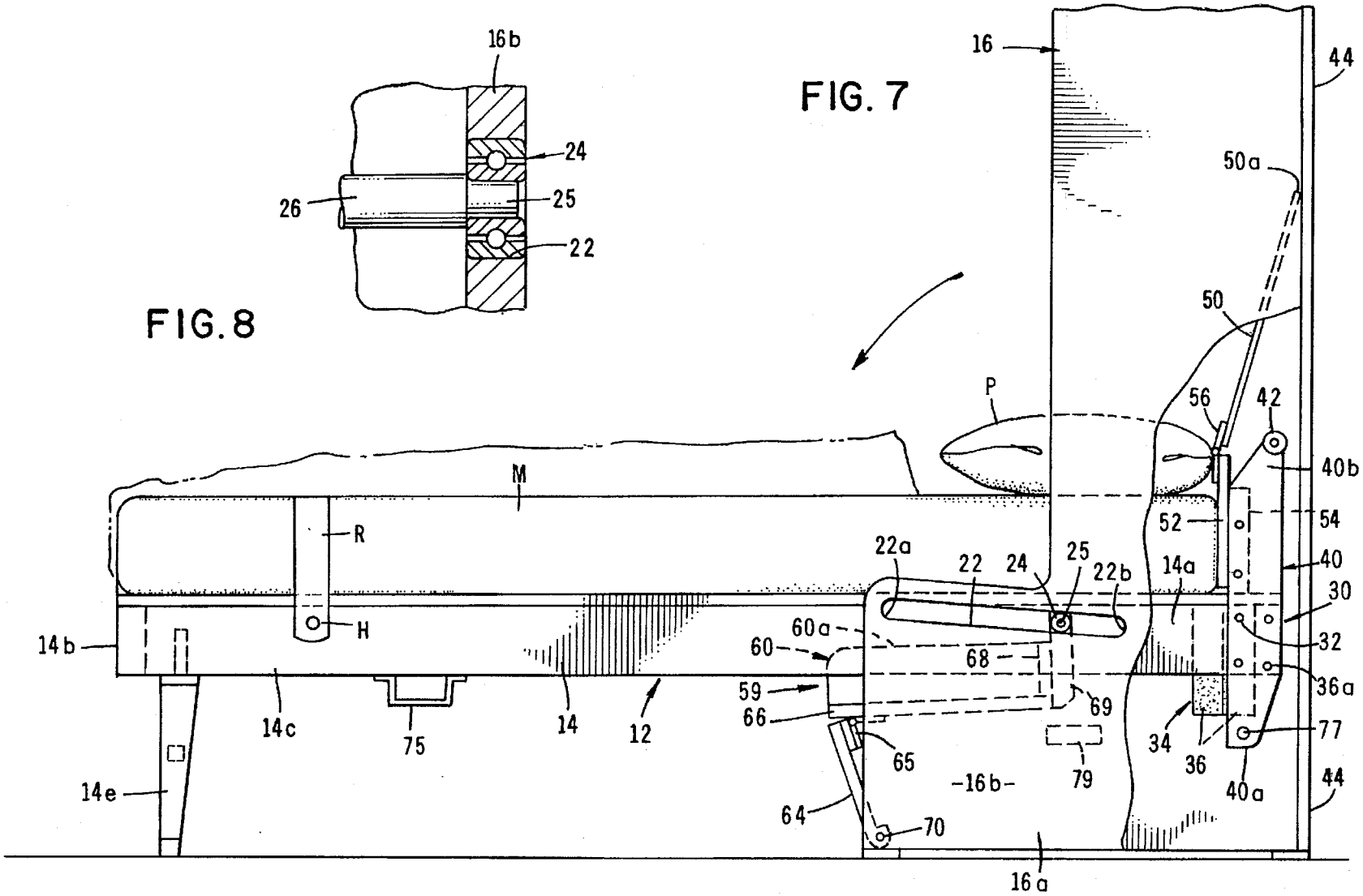
FIG. 7 is a side-elevational view similar to FIG. 6, but showing the bed in a fully downward, operational configuration.
FIG. 8 is a greatly enlarged, fragmentary view of one of the supporting bearings of the invention.

Connected proximate front end 14*a* of bed pallet 14 is counterbalance means for urging pivotal movement of bed pallet 14 about rollers 24 between its first generally horizontal position shown in FIG. 7 and its second generally vertical position shown in FIG. 2. The counterbalance means here comprises a supporting subassembly 30 which is connected to the forward end of bed pallet 14 by a plurality of connectors 32 (FIG. 2). As indicated in FIG. 3, support assembly 30 includes a centrally disposed weight-supporting, box-like metal framework 34 which is adapted to support a plurality of weights 36 such as concrete bricks 36. Support 34 is interconnected with a transversely extending structural member 38 which spans sides 14*c* of pallet 14 and is interconnected therewith by elongated connectors 32*a* (FIG. 3). Support assembly 30 also includes two transversely spaced-apart metal side plates 40, each of which has a first end 40*a* and a second end 40*b* (FIG. 2). Mounted proximate end 40*b* of each of the plates 40 are surface engaging means, here provided as front rollers 42, the purpose of which will presently be described.

Turning particularly to FIG. 2, it is to be noted that, when the bed pallet and the mattress "M" are in their second substantially vertical position, side rollers 24 are located proximate the inboard end 22*b* of slot 22. However, as the bed pallet is moved toward its downward position, that is in the direction of the arrow 23 in FIG. 2, when the pallet reaches the position shown by the phantom lines in FIG. 2, rollers 24 have rolled forwardly along tracks 22 to an intermediate position shown by the phantom lines in FIG. 2. Continued downward movement of bed pallet 14 to the position shown in FIG. 6 causes rollers 24 to move into a position wherein they are approximately centered within tracks 22. As the bed pallet continues to move downwardly in the direction of the arrow in FIG. 7, rollers 24 will, once again, move toward inboard extremity 22*b* of tracks 22 in the manner shown in FIG. 7.

Forming an important aspect of the apparatus of the present invention, is the provision of the previously identified surface engaging means, or front rollers 42, which roll along a surface defining means as the bed pallet pivots between its first and second positions. It is important to note that, due to the inclined configuration of tracks 22, as the bed pallet moves between its first and second position, rollers 42 will be continuously urged against the surface defining means which is here provided in the form of the generally planar back panel or wall 44 of enclosure 16. More particularly, as the bed pallet moves from the vertical position shown in FIG. 2 in a direction toward the horizontal position, rollers 42 will roll along wall 44 progressively upwardly from the bottom of wall 44 (FIG. 2) to the intermediate position shown in FIG. 6. This movement simultaneously causes rollers 24 to roll along inclined tracks 22 in the manner shown in the drawings (see, for example FIGS. 2, 6, and 7). When pallet 14 reaches the horizontal position shown in FIG. 7, rollers 42 move away from wall 44 and rollers 24 roll downwardly a limited distance along tracks 22.

Figure 4:
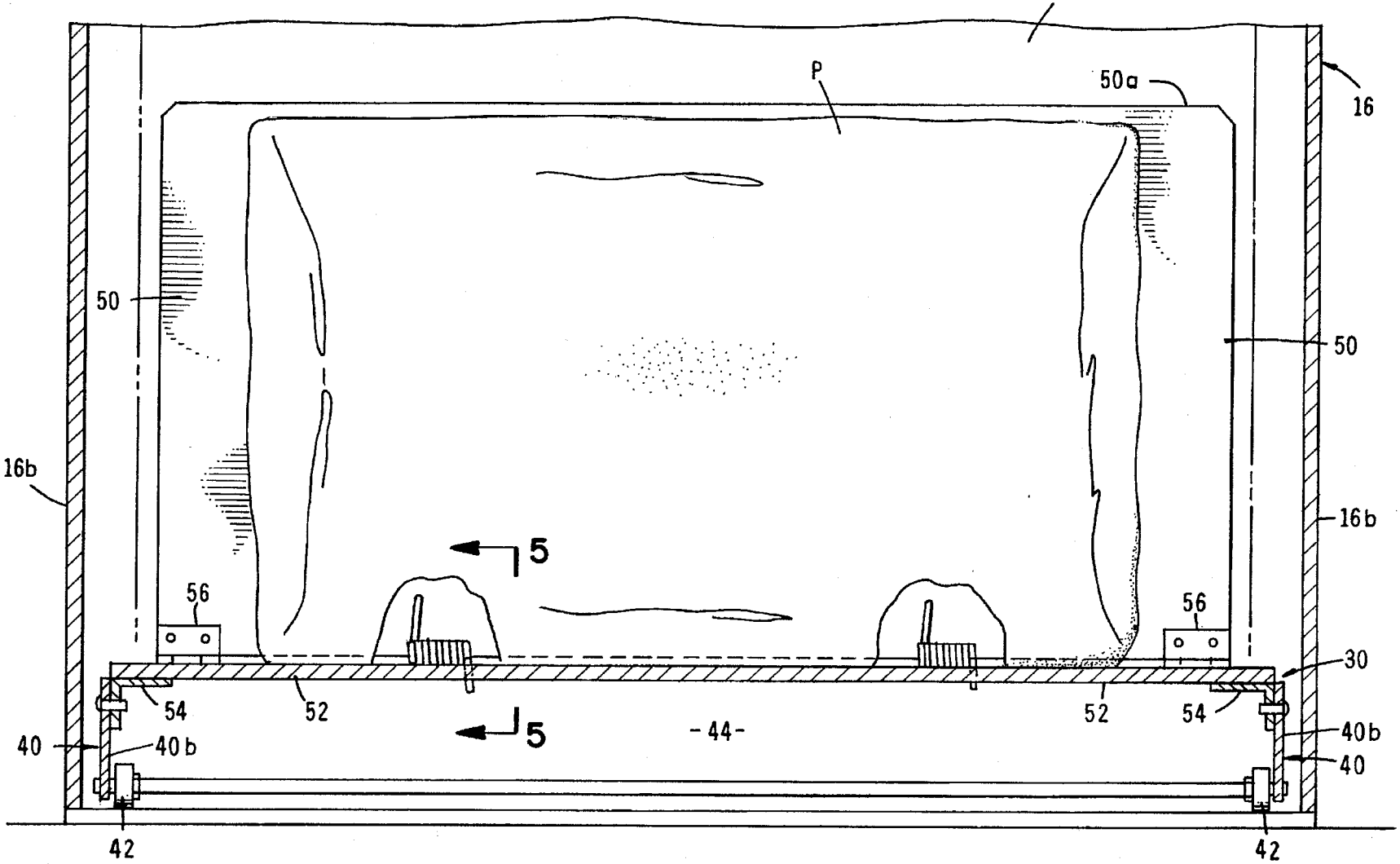
FIG. 4 is a cross-sectional view taken along lines 4—4 of FIG. 2.

Forming another important feature of the apparatus of the present invention is pillow engaging means for engaging a pillow "P" resting on the mattress "M" and appropriately supporting the pillow as the pallet and mattress move from the horizontal operable position toward the stowed vertical position. As best seen in FIGS. 2 and 4, the pillow engaging means is here provided in the form of a generally planar panel 50 which is hingeably connected to the bed pallet assembly 12. More particularly, panel 50 is interconnected by a pair of hinges 56 with a forwardly disposed, transversely extending structural member 52 which, in turn, is connected to plate-like members 40 by means of suitable angle brackets 54 (see FIG. 4). As indicated in FIGS. 2 and 4, one leaf of each of the transversely, spaced-apart hinges 56 is connected to member 50 while the other leaf is connected to structural member 52.

Disposed intermediate hinges 56 is a pair of biasing means, shown here as torsion springs 58 which function to continuously urge the free edge 50*a* of panel 50 toward back panel 44 of enclosure 16 (see FIGS. 4 and 5). With this construction, as the bed pallet 14 is moved from its generally horizontal position shown in FIG. 7 to its substantially vertical position shown in FIG. 2, edge 50*a* of panel 50 will slide along panel 44 from the upper position shown in FIG. 7 to the downward position shown in FIG. 2. As the bed pallet moves toward its vertical position, the pillow "P" will move into engagement with panel 50 and will be securely encapsulated between panel 50 and the mattress "M" as the bed pallet assembly moves into its generally vertically stowed position shown in FIG. 2. Conversely, as the bed pallet assembly is moved from the vertical storage position downwardly toward the horizontal position as shown in FIG. 6, the pillow "P" will move from the position shown in the phantom lines of FIG. 6, where it rests against panel 50, into a position where it rests against mattress "M". In this way, the pillow is at all times secured in the correct position relative to the mattress so that, when the assembly is moved into the operational configuration, the pillow will correctly rest upon mattress "M".

Another important feature of the apparatus of the invention comprises seating means for providing seating for at least one person when the bed pallet is in the second stowed position. As best seen by referring to FIG. 1, this seating means here comprises a seating assemblage 59 which comprises a transversely extending lower seat assembly 60 and a cooperating upper back support 62. When the apparatus is in the stowed configuration shown in FIG. 1, the upper surface 60*a* of seat assembly 60 is disposed at an ideal height to receive one or more persons for comfortable seating on the seating means.

As can be observed by referring to FIGS. 2, 6, and 7, seat assembly 60 includes a transversely extending front member 64 which is hingeably connected by hinges 65 to a transversely extending support member 66. Member 66 is, in turn, connected to a downwardly extending rearwardly disposed member 68. As best seen by referring to FIG. 3, member 68 is swingably suspended from transverse bar 26 by means of a pair of transversely spaced-apart supporting brackets 69 having apertured ears 69*a* which receive bar 26. The lower corners 64*a* of support member 64 are pivotally connected to base portions 16*b* by means of pivot pins 70. With this construction, as the bed pallet assembly moves from the vertical stowed position shown in FIG. 2 toward the horizontal operational position, the seat assembly will swing downwardly and forwardly with brackets 69 swinging relative to bar 26 and member 64 pivoting about pivot pins 70 (see FIG. 6). As the pallet assembly continues to move into its horizontal position, the seating means will move into the stowed configuration shown in FIG. 7, wherein it remains clear of the bed pallet assembly and in no way interferes with the free movement of the pallet assembly into its operational configuration shown in FIG. 7.

Figures 9, 10:
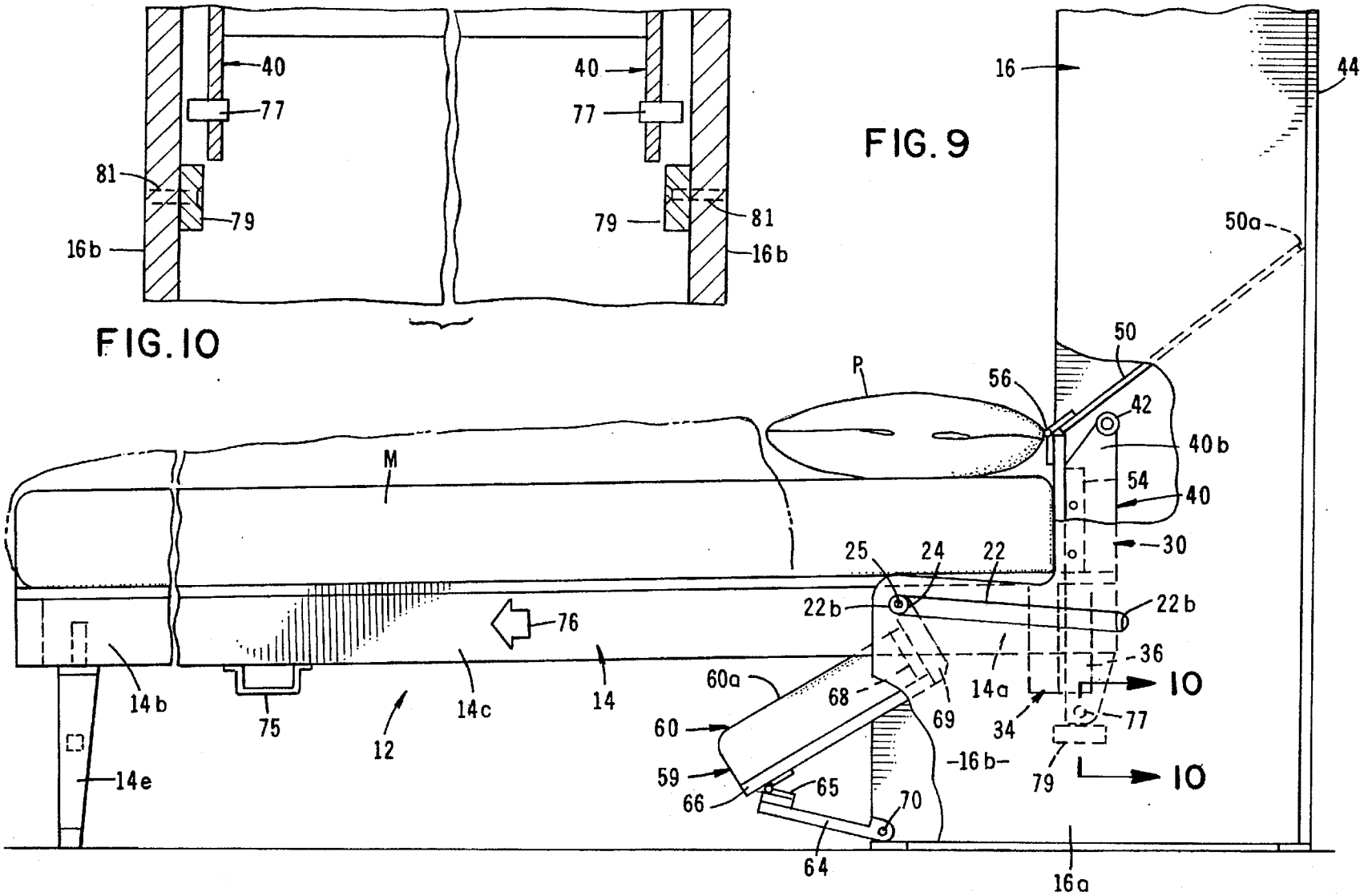
FIG. 9 is a side-elevational view similar to FIG. 7, but showing the bed having been moved horizontally to an extended position relative to the enclosure housing.
FIG. 10 is a greatly enlarged, cross-sectional view taken along lines 10—10 of FIG. 9 showing one form of the locking means of the invention to prevent inadvertent movement of the bed pallet toward the stowed position.
Figure 15:
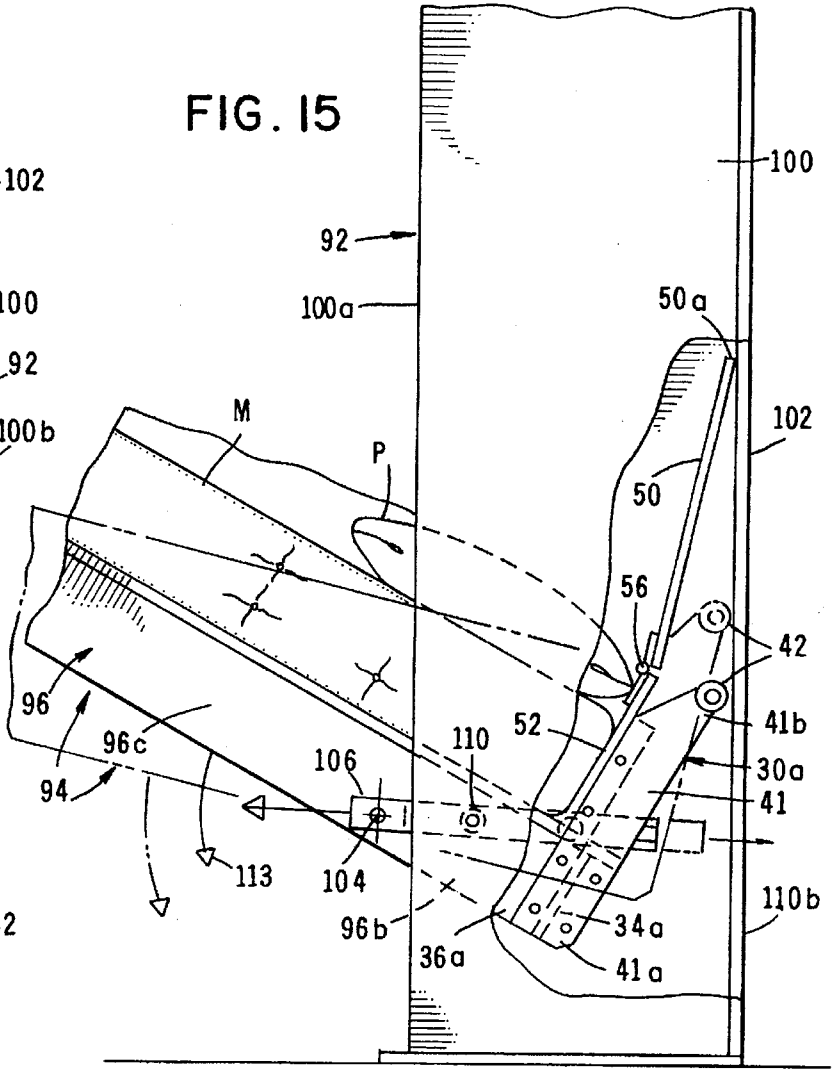
FIG. 15 is a side-elevational view similar to FIG. 14, but illustrating further movement of the folding bed from a stowed configuration toward an operable configuration.

Turning next to FIGS. 7 and 9, it is to be observed that as the bed pallet assembly is moved from its first forward position shown in FIG. 7 to its second extended position shown in FIG. 9, seat assembly 60 will pivot further downwardly into the configuration shown in FIG. 9 as rollers 24 roll outwardly along track 22. Once again, forward support member 64 will simultaneously pivot about pivot pins 70 and swing relative to hinges 65 from the position shown in FIG. 7 to the fully downward retracted position shown in FIG. 9. The novel construction thus described permits the seating means to remain in a non-interfering retracted position when the bed pallet assembly is in the horizontal operational configuration and then to automatically move into the seating position shown in FIGS. 1 and 2 when the bed pallet assembly is moved into its stowed configuration shown in FIGS. 1 and 2.

In using the apparatus of the present invention, with the apparatus in the position shown in FIGS. 1 and 2, the user grasps the bed pallet assembly by means of transversely spaced-apart handle-like members 75. An outward and downward force exerted on handles 75 in the direction of the arrow 23 of FIG. 2 will cause the bed pallet assembly to move slowly and smoothly into the position shown in phantom lines in FIG. 2. To secure the mattress in position relative to the pallet assembly, an easily removable restraining strap "R" and cooperating connector hook H can be provided if desired (FIG. 2). As the assembly reaches the position shown in FIG. 6, the seating assembly will move into the partially collapsed configuration there shown and the pallet assembly will continue to move smoothly toward the horizontal operational configuration shown in FIG. 7 wherein pallet 14 is supported by a pair of rear legs 14*e*. For sleeping purposes, or when it is desired to make up the bed, the bed pallet assembly can be moved horizontally in the direction of the arrow 76 of FIG. 9 from the first forwardmost position shown in FIG. 7 to the second extended position shown in FIG. 9. As previously mentioned, as the bed pallet assembly moves into this extended position, the seating means will collapse further into the configuration shown in FIG. 9.

Another extremely important feature of the apparatus of the present invention comprises locking means for locking the bed pallet assembly in the extended position shown in FIG. 9 and preventing the counterbalance means from inadvertently moving the assemblage upwardly toward the vertical stowed position.

As best seen by referring to FIGS. 9 through 12, this novel locking means here comprises a pair of transversely spaced-apart locking pins 77 which are carried proximate ends 40*a* of metal brackets or members 40. As the bed pallet assembly is moved into the extended position shown in FIG. 9, locking pins 77 will move to a location closely adjacent a pair of stop members 79 which are affixed to base portions 16*b* by suitable fasteners such as fasteners 81 (FIG. 10). Turning particularly to FIGS. 11 and 12, when the pallet assembly is in the extended position, and an upward force is exerted on the pallet assembly in the direction of the arrow 80 of FIG. 11 as, for example, when the bed is being made up, the forward end of the bed pallet assembly will tend to move downwardly in the direction of the arrow 83 of FIG. 11 causing locking pins 77 to move into blocking engagement with stops 79 so as to effectively block further movement of the forward portion of the bed pallet assembly in the direction of arrow 83 and thereby preventing further travel of the pallet assembly toward its vertical stowed position. Only after the bed is made up and the pallet assembly moved forwardly to the position shown in FIG. 7, will the locking pins move clear of stops 79 so as to permit free pivotal movement of the pallet assembly from the horizontal position shown in FIG. 7 into the vertical stowed position shown in FIG. 2.

Figure 13:
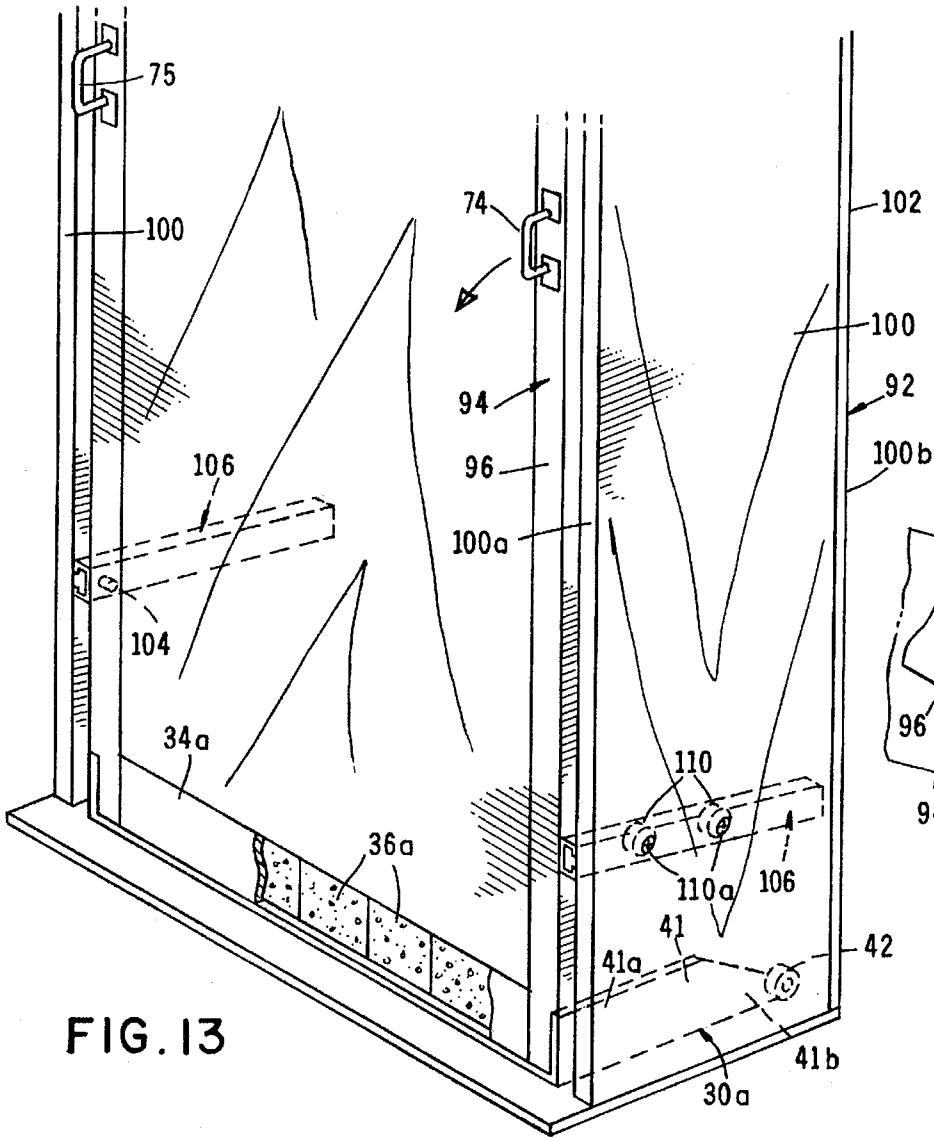
FIG. 13 is a fragmentary, generally perspective view of an alternate embodiment of the counterbalanced moving pivot folding bed of the invention.

Referring to FIGS. 13 through 22, an alternate form of the counterbalanced, moving-pivot, folding-bed apparatus of the present invention is there illustrated. This embodiment is similar in some respects to the embodiment just discussed and like numbers are used to identify like components. As indicated in FIG. 13, this embodiment of the invention also comprises a free-standing unit which includes a storage enclosure 92 for enclosing the bed pallet of the apparatus when the bed pallet is in its stowed, substantially vertical position. For reasons presently to be discussed, enclosure 92 is of a width substantially less than the overall width of the storage enclosure of the first embodiment of the invention thereby making the Unit even more compact.

Figures 16, 18:
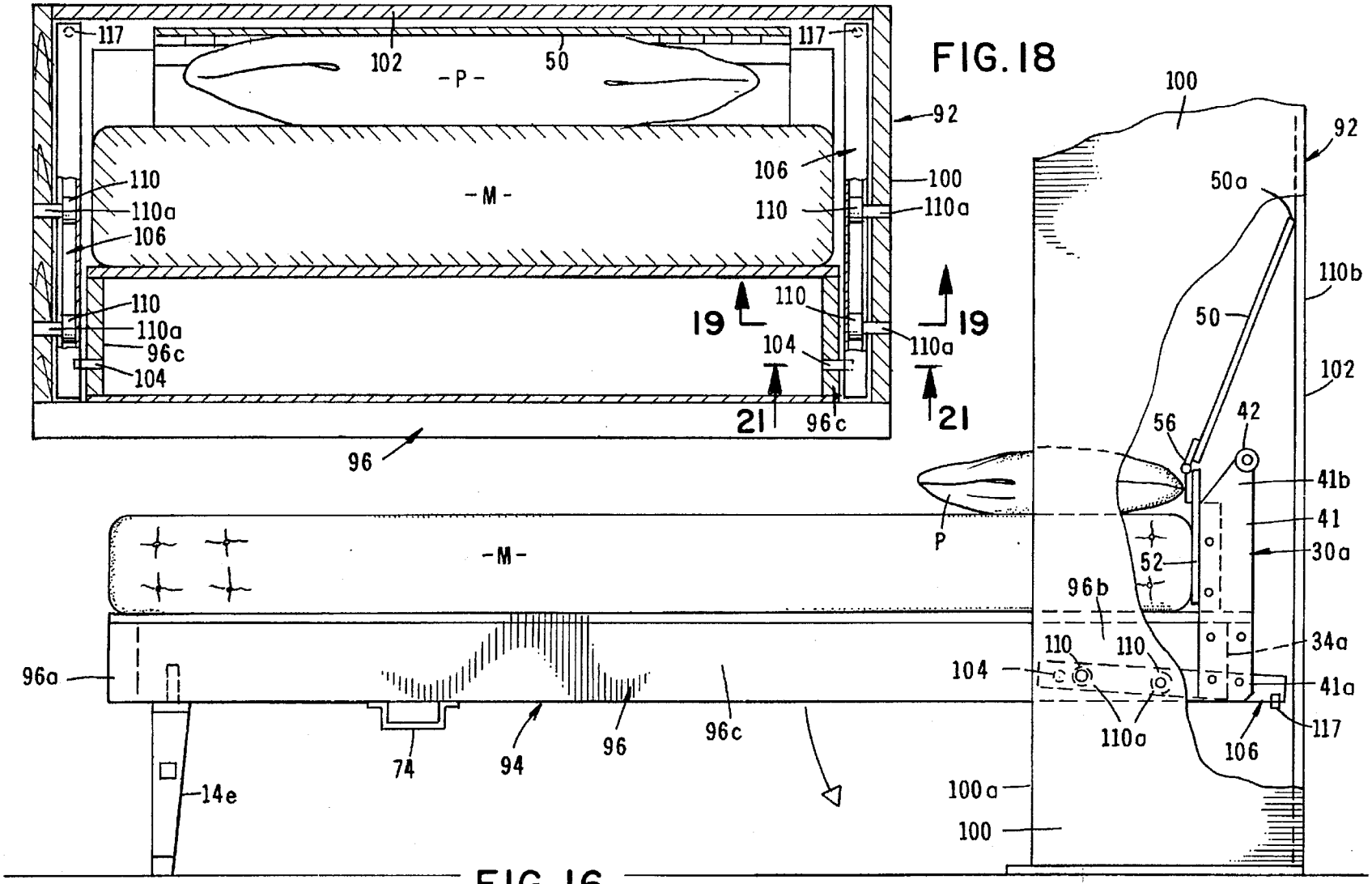
FIG. 16 is a side-elevational view partly broken away to show internal construction of this latest form of the invention in a downward operative position.
FIG. 18 is a cross-sectional view taken along lines 18—18 of FIG. 14.

Turning to FIGS. 16 and 18, it can be seen that the bed pallet assembly 94 of the apparatus comprises a mattress-supporting bed pallet 96 having a rearward or outboard end 94*a*, a front or inboard end 96*b*, and a pair of transversely, spaced-apart sides 96*c* (see also FIG. 18). It is to also be noted that enclosure structure 92 is here formed by two relatively narrow, transversely spaced-apart side portions 100 and a connecting back portion 102.

Figure 14:
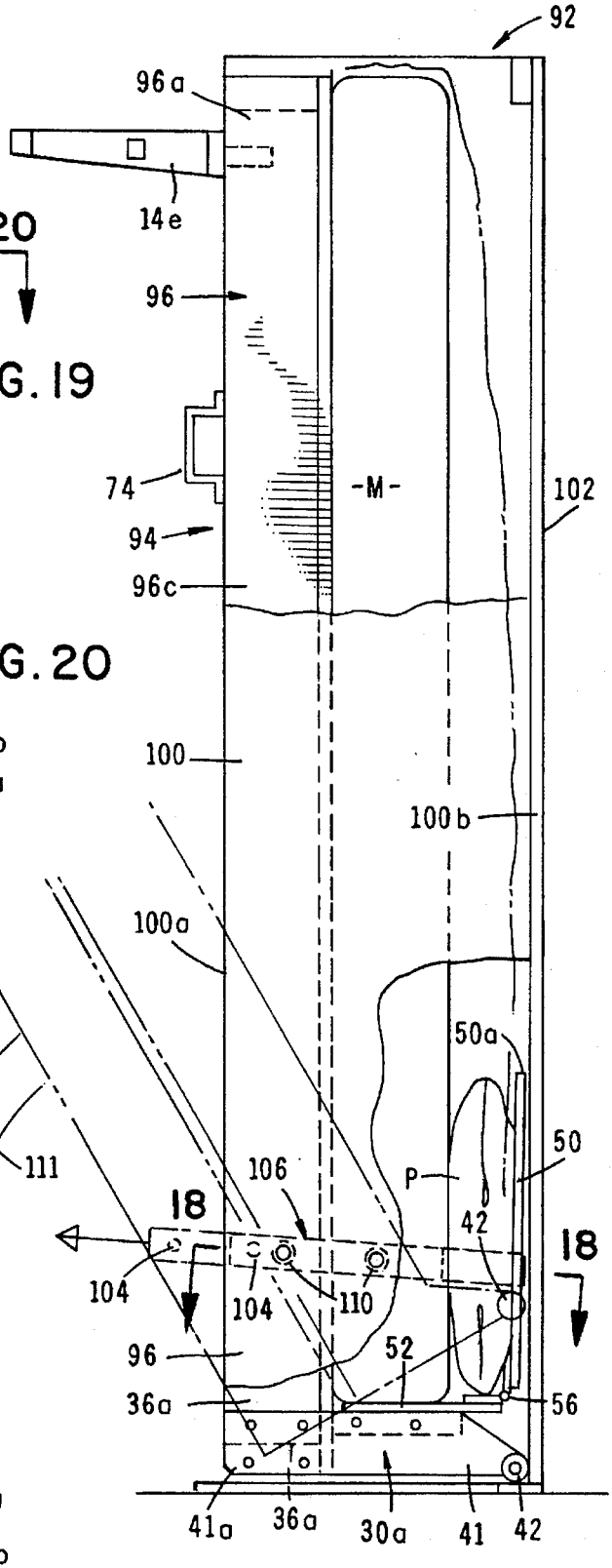
FIG. 14 is a side-elevational view of the embodiment of the invention shown in FIG. 13.

Pivot means, here comprising a pair of pivot axles 104 which are connected to sides 96*c* of the bed pallet intermediate the ends thereof, function to pivotally support the bed pallet for pivotal movement thereof between a substantially horizontal first position as shown in FIG. 16 and a substantially vertical second position as shown by the solid lines in FIG. 14.

Figure 19:
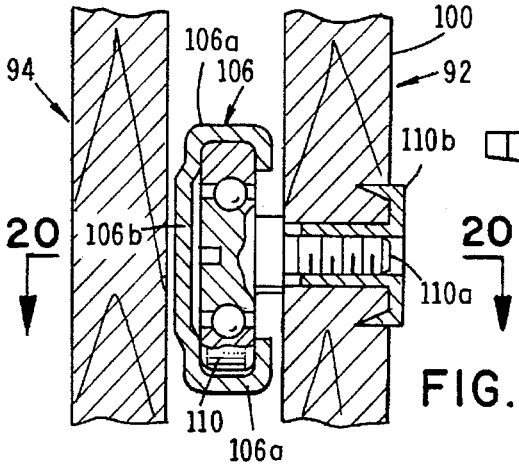
FIG. 19 is a cross-sectional view taken along lines 19—19 of FIG. 18.
Figure 20:
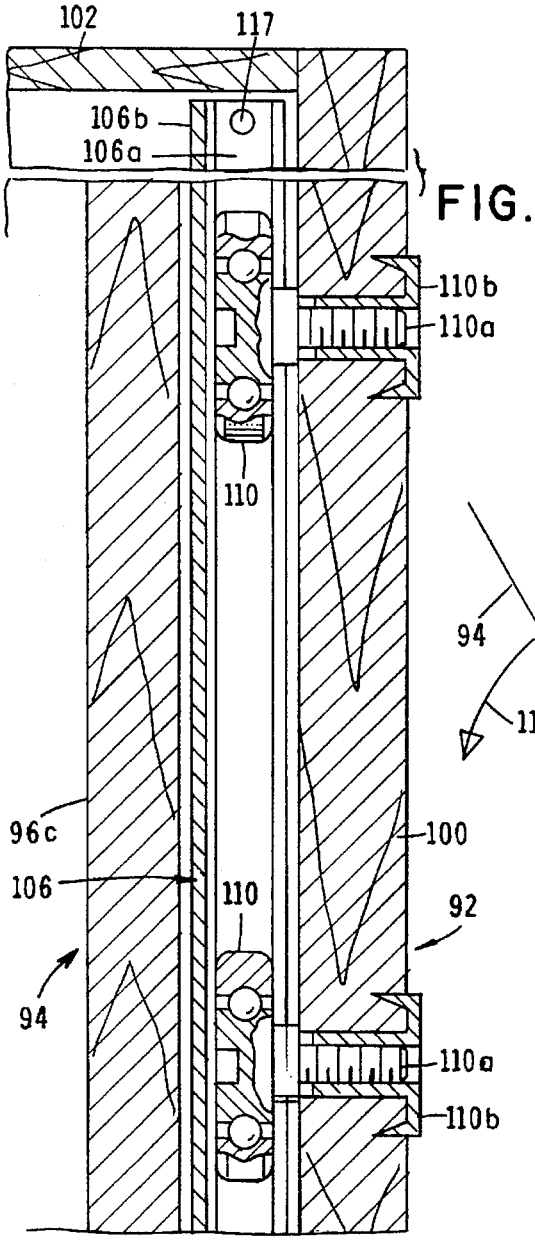
FIG. 20 is a cross-sectional view taken along lines 20—20 of FIG. 19.
Figures 17, 21, 22:
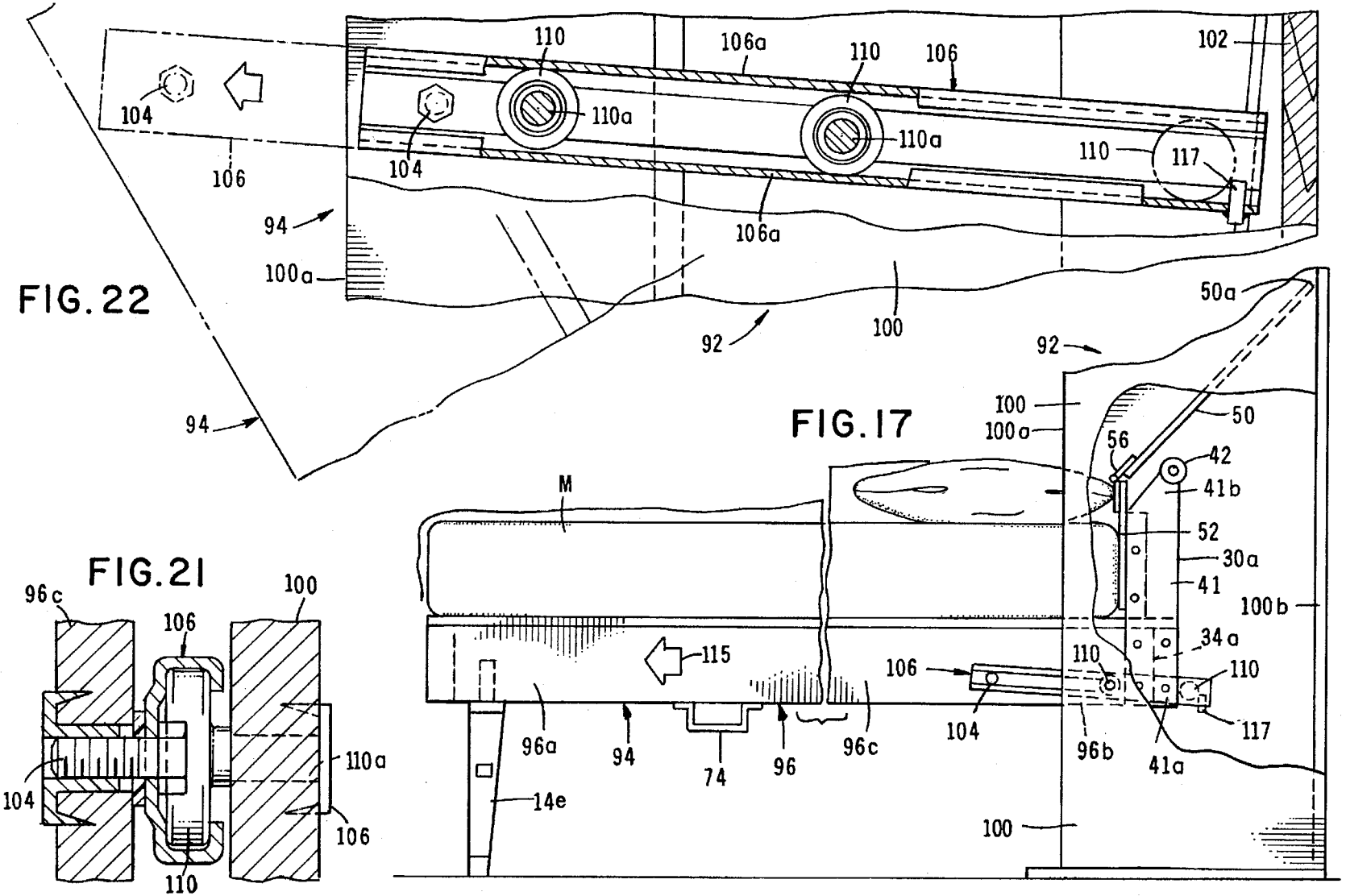
FIG. 17 is a foreshortened, side-elevational view similar to FIG. 16, but showing the folding bed moved outwardly from the bed enclosure.
FIG. 21 is a cross-sectional view taken along lines 21—21 of FIG. 18.
FIG. 22 is an enlarged, fragmentary, side-elevational view illustrating the operating of the moving slide portion of the apparatus.

Each pivot axle 104 is connected to an elongated slide member 106 which, as shown in FIG. 19, is generally U-shaped in cross section having spaced apart sides 106*a* and an interconnecting bite portion 106*b*. Slide members 106 form a part of the moving means of this latest form of the invention for moving the bed pallet in a generally horizontal direction from the first retracted position shown in FIG. 16 to the second extended position shown in FIG. 17. As best seen in FIGS. 18 and 22, each of the slide members 106 is supported by a pair of support rollers 110 which are mounted in a spaced-apart relationship on side walls 100 of the enclosure structure 92 for rotation about axles 110*a*. Axles 110*a* are, in turn, supported by spaced-apart bushings 110*b* that are secured to sides 100. Turning to FIG. 19, it can be seen that the support rollers 110 are disposed in rolling engagement with sides 106*a* of the slide member 106 so that the slide members can move from a first retracted position shown in FIG. 16 to a second extended position shown in FIG. 17. With this construction, the bed pallet assembly pivotally moves about pivot axles 104 rather than pivotally moving about axles 25 that support rollers 24 as was the case in the first embodiment of the invention.

Connected proximate front end 96*b* of bed pallet 96 is counterbalance means for urging pivotal movement of the bed pallet about pivot axles 104 between its first generally horizontal position shown in FIG. 16 and its second, generally vertical position shown by the solid lines in FIG. 14. The counterbalance means here comprises a supporting subassembly 30*a* which is of similar construction and operation to subassembly 30 as previously described herein. Supporting subassembly 30*a* also includes a centrally disposed weight-supporting, box-like metal framework 34*a* which is adapted to support a plurality of weights 36*a* such as concrete bricks. Support assembly 30*a* also includes two transversely spaced-apart side plates 41, each of which has a first end 41*a* and a second end 41*b*. Mounted proximate end 41*b* of each plate 41 is a surface engaging means, here shown as front rollers 42.

Turning particularly to FIG. 14 it is to be noted that, when the bed pallet and the mattress "M" are in their second substantially vertical position, the pivot axles 104 are located proximate the forward end 100*a* of enclosure sides 100. However, as the bed pallet is moved toward its downward position, that is in the direction of the arrow 111 in FIG. 14, when the pallet reaches the position shown by the phantom lines in FIG. 14, axles 104 have moved forwardly along with slides 106 to an intermediate position shown by the phantom lines in FIG. 14. Continued downward movement of bed pallet 96 to the position shown in FIG. 15 causes the pivot axles to move into a position wherein they are positioned outwardly of the forward end 100*a* of enclosure sides 100. As the bed pallet continues to move downwardly in the direction of the arrow in FIG. 113, pivot axles will, once again, move toward end 100*b* of enclosure sides 100 in the manner shown in FIG. 16.

Forming an important aspect of the apparatus of this latest form of the invention is the provision of the surface engaging means or front rollers 42 which roll along a portion of the surface of the back wall 102 of the enclosure as the bed pallet pivots between its first and second positions. It is important to note that, due to the incline of slide members 106, as the bed pallet moves between its first and second position, rollers 42 will be continuously urged against the inner surface of the generally planar back panel or wall 102 of enclosure 92. More particularly, as the bed pallet moves from the vertical position shown in FIG. 14 in a direction toward the horizontal position, rollers 42 will roll along wall 102 progressively upwardly from the bottom of wall 102 (FIG. 14) to the intermediate position shown in FIG. 15. This movement simultaneously causes slides 106 to move relative to support rollers 110 in the manner shown in the drawings (see, for example, FIGS. 14, 15 and 16). When pallet 96 reaches the horizontal position shown in FIG. 16, rollers 42 move away from wall 102 and axles 104 move outwardly a limited distance.

Forming another important feature of the apparatus of the form of the invention shown in FIGS. 13 through 22 is pillow engaging means for engaging a pillow "P" resting on the mattress "M" and appropriately supporting the pillow as the pallet and mattress move from the horizontal operable position toward the stowed vertical position. The pillow engaging means here provided is identical to that previously described in connection with the form of the invention shown in FIGS. 1 through 12 and, therefore, will not be here further described.

As before, as the bed pallet moves toward its vertical position, the pillow "P" will move into engagement with panel 50 and will be securely encapsulated between panel 50 and the mattress "M" as the bed pallet assembly moves into its generally vertically stowed position shown in FIG. 14. Conversely, as the bed pallet assembly is moved from the vertical storage position downwardly toward the horizontal position as shown in FIG. 16, the pillow "P" will move into the position shown in FIG. 16 where it rests against mattress "M". In this way, the pillow is at all times secured in the correct position relative to the mattress so that, when the assembly is moved into the operational configuration, the pillow will correctly rest upon mattress "M".

In using the apparatus of this latest form of the invention, with the apparatus in the position shown in FIG. 14, the user grasps the bed pallet assembly by means of transversely spaced-apart handle-like members 74 and 75. An outward and downward force exerted on the handles in the direction of the arrow 111 of FIG. 14 will cause the bed pallet assembly to move slowly and smoothly into the position shown in phantom lines in FIG. 14. To secure the mattress in position relative to the pallet assembly, an easily removable restraining strap "R" and cooperating connector hood "H" can be provided if desired (FIG. 2). After the assembly reaches the position shown in FIG. 15, the pallet assembly will continue to move smoothly toward the horizontal operational configuration shown in FIG. 16 wherein pallet 96 is supported by a pair of rear legs 14*e*. As before, for sleeping purposes, or when it is desired to make up the bed, the bed pallet assembly can be moved horizontally in the direction of the arrow 115 of FIG. 17 from the first forward-most position shown in FIG. 16 to the second extended position shown in FIG. 17. As previously mentioned, as the bed pallet assembly moves into this extended position, slides 106 will smoothly roll along support rollers 118 in the manner shown in FIG. 22.

Another important feature of the apparatus of this latest embodiment of the invention comprises stop means carried by slides 104 for limiting forward movement of the slide members. These stop means here comprise locking fingers 117 which are affixed to slides 106 proximate their inboard ends so that they will engage the rearward most support roller when the slides are fully extended thereby stopping further forward movement of the slides.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A folding bed apparatus comprising:

(a) a mattress-supporting bed pallet having a front end, a rear end and a pair of transversely spaced sides;

(b) pivot means comprising a pair of pivot axles connected to said sides of said bed pallet intermediate said front and rear ends thereof for pivotally supporting said bed pallet for pivotal movement thereof between a substantially horizontal first position and a substantially vertical second position;

(c) a storage enclosure for enclosing said bed pallet when said bed pallet is in said second position;

(d) surface engaging means connected to said bed pallet proximate the front end thereof;

(e) surface defining means provided on said storage enclosure for engagement by said surface engaging means as said bed pallet pivots between said first and second positions;

(f) counterbalance means connected to said bed pallet for urging pivotal movement of said bed pallet toward said second position; and (g) means for moving said bed pallet between a first forward position proximate said surface defining means to a second rearward position spaced apart from said surface defining means, said means for moving said bed pallet comprising:

(i) a pair of support rollers mounted on each of said side walls of said enclosure; and (ii) a slide connected to each of said pivot axles of said pivot means, each said slide being in rollable engagement with one pair of said pairs of support rollers.

2. A folding bed apparatus for use in connection with a mattress and a pillow comprising:

(a) a bed pallet assembly for supporting the mattress, said bed pallet assembly including a pallet having a forward end, a rearward end and a pair of transversely spaced sides;

(b) pivot means comprising a pivot axle connected to each of said sides of said pallet intermediate said front and rear ends thereof, said pallet being pivotable about said side pivot axle between a substantially horizontal first position and a substantially vertical second position and being movable between a first forward position and a second rearward position;

(c) a storage enclosure for enclosing said bed pallet when said bed pallet, is in said second position, said storage enclosure comprising a pair of spaced apart side walls and a rear wall connected to said side walls;

(d) locking means carried by said base for locking said pallet against pivotal movement when said pallet is in said second rearward position;

(e) surface engaging means connected to said pallet proximate the front end thereof for engagement with said rear wall of said storage enclosure as said bed pallet pivots between said first and second positions;

(f) a weight connected to said pallet for urging pivotal movement of said bed pallet toward said second position; and (g) means for moving said bed pallet in a generally horizontal direction between a first forward position wherein it is proximate said rear wall of said storage enclosure to a second rearward position spaced apart from said rear wall, said moving means comprising:

(i) a pair of support rollers mounted on each of said side walls of said storage enclosure; and (ii) a pair of elongated slides each having body portion and an end portion, said end portion of each slide being connected to one of said pivot axles of said pivot means, said body portion of each said slide being in rollable engagement with one pair of said pairs of support rollers mounted on said side walls of said storage enclosure.

3. An apparatus as defined in claim 2 in which said body portion of each slide is generally U shaped in cross section and includes spaced apart side walls interconnected by a bight portion, said support rollers being receivable between said spaced apart side walls for rolling engagement therewith.

4. An apparatus as defined in claim 2 in which one of said support rollers of each pair of support rollers is vertically elevated with respect to the other said support roller, whereby said slide extends angularly downward relative to horizontal.

* * * * *